US006480084B1

(12) United States Patent
Saito et al.

(10) Patent No.: US 6,480,084 B1
(45) Date of Patent: Nov. 12, 2002

(54) INDUCTANCE ELEMENT AND MANUFACTURING METHOD THEREOF, AND SNUBBER USING THEREOF

(75) Inventors: Tadao Saito, Yokohama (JP); Yasuaki Moriya, Matsudo (JP); Kazumi Sakai, Yokohama (JP); Takao Kusaka, Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/606,188

(22) Filed: Jun. 29, 2000

(30) Foreign Application Priority Data

Jun. 30, 1999 (JP) ..... 11-187074
Jun. 13, 2000 (JP) ..... 2000-177261

(51) Int. Cl.[7] ..... H01F 27/30

(52) U.S. Cl. ..... 336/198; 336/192; 336/212; 336/213; 336/234

(58) Field of Search ..... 336/198, 192, 336/234, 212, 221, 213

(56) References Cited

U.S. PATENT DOCUMENTS

| | | | | |
|---|---|---|---|---|
| 3,858,138 A | * | 12/1974 | Gittleman et al. | 336/136 |
| 5,877,669 A | * | 3/1999 | Choi et al. | 336/200 |
| 6,204,744 B1 | * | 3/2001 | Shafer et al. | 336/83 |

FOREIGN PATENT DOCUMENTS

| | | |
|---|---|---|
| GB | 840412 | 7/1960 |
| JP | 58 044704 | 3/1983 |
| JP | 59-145512 | 8/1984 |
| JP | 02 148705 | 6/1990 |
| JP | 5-90039 | 4/1993 |
| JP | 11 016733 | 1/1999 |
| JP | 11-275859 | * 10/1999 |

* cited by examiner

*Primary Examiner*—Lincoln Donovan
*Assistant Examiner*—Tuyen Nguyen
(74) *Attorney, Agent, or Firm*—Foley & Lardner

(57) ABSTRACT

An inductance element comprises a coil having a hollow portion opened at both ends and provided with a winding of which number of turns (N) per length 10 mm is 20 or more and 500 or less, and a core having a single layer or a plurality of layers of magnetic ribbon of a thickness of 4 $\mu$m or more and 50 $\mu$m or less and a width of 2 mm or more and 40 mm or less, at least part thereof being disposed in the hollow portion. In such an inductance element, a ratio (N/n) of a number of turns (N) of the coil per length 10 mm to a number of layers (n) of the magnetic ribbon is set at 20 or more and 500 or less. The magnetic ribbon, for instance in a state disposed in the hollow portion of the coil, has an open magnetic circuit structure. Instead, the magnetic ribbon, by disposing penetrating the hollow portion and magnetically connecting both ends thereof, forms a closed magnetic circuit loop. Such an inductance element possesses excellent inductance characteristics and is good in winding efficiency.

23 Claims, 12 Drawing Sheets

EMBODIMENT 1

EMBODIMENT 2

EMBODIMENT 3

EMBODIMENT 4

COMPARATIVE EXAMPLE 1

COMPARATIVE EXAMPLE 2

COMPARATIVE EXAMPLE 3

COMPARATIVE EXAMPLE 4

EMBODIMENT 5

EMBODIMENT 6

EMBODIMENT 7

EMBODIMENT 8

EMBODIMENT 9

COMPARATIVE EXAMPLE 5

COMPARATIVE EXAMPLE 6

INDUCTANCE ELEMENT AND MANUFACTURING METHOD THEREOF, AND SNUBBER USING THEREOF

BACKGROUND OF THE INVENTION

1. Field of the Invention

The present invention relates to an inductance element and a delay element used for a snubber of a switching power source and a method of manufacturing the same, and a snubber using the same.

2. Description of the Related Art

An inductance element is used in various kinds of electric circuit. For instance, in a switching power source of a ringing choke converter, as a current delay element that delays gate signal of a MOS-FET that is a switching element, an inductance element (saturable inductor) is used. The current delay element makes a snubber condenser function as a resonant condenser to implement zero-voltage switching of the MOS-FET.

As an existing inductance element, one that has a toroidal core formed by winding or stacking for instance a soft magnetic alloy ribbon is mainly used. In applying such an inductance element to the aforementioned current delay element, a plurality of turns of sheathed wire is wound around a toroidal core of closed magnetic circuit structure to obtain prescribed characteristics.

The inductance element having a toroidal core is advantageous in obtaining inductance based on the closed magnetic circuit structure thereof. However, in an toroidal core constituted of a soft magnetic alloy ribbon, different from a sintered core consisting of a ferrite sintered body, a configuration where in advance magnet wire is wound around an insulated bobbin, thereto divided sintered core being butted to constitute a closed magnetic circuit can not be applied with ease.

In order to apply a toroidal core in the aforementioned bobbin structure, similarly with a U-character cut core, a step where the core, after being impregnated with resin, is cut and inserted in the bobbin is necessary. Such processing step not only lowers a manufacturing efficiency of elements to push up the manufacturing cost but also deteriorate magnetic properties due to the cutting of the toroidal core.

From the above, in employing a toroidal core constituted of the existing soft magnetic alloy ribbon, it is general to directly implement the winding to the toroidal core to constitute an inductance element. However, in such a constitution, processing efficiency in implementing the winding to the toroidal core is low, in addition there are difficulties in implementing automation in the winding step. Thereby, the manufacturing cost of the inductance element is pushed up.

In the existing inductance element, in order to reduce number of turns to the toroidal core, for the soft magnetic alloy ribbon, material of high permeability is applied. Thereby, the core of which effective cross-section is increased is used. Even when such a configuration is applied, a problem of inefficiency of the winding can not be cancelled, there fundamentally remains a problem of low productivity.

Further, in a structure where the direct winding is applied to the toroidal core, a core of strength capable of enduring the winding is necessary. Accordingly, resin coating is applied to the toroidal core, or the toroidal core is put in a resin case to use. These steps also cause an increase in the manufacturing cost of the inductance element.

As mentioned above, in the existing inductance element, a structure where the winding is given to a toroidal core consisting of a wound body or a stacked body of a magnetic ribbon is general. A processing efficiency of the winding to the toroidal core is bad and the winding step accompanies difficulties in automating. These cause an increase of the manufacturing cost of the inductance element. Further, to give strength enough to endure the winding operation, the resin coating or resin case is used. These also cause an increase of the manufacturing cost of the inductance element.

SUMMARY OF THE INVENTION

Accordingly, an object of the present invention is to provide an inductance element that, while maintaining excellent inductance characteristics, owing to an improvement of processing efficiency of the winding step, enables to drastically lower the manufacturing cost and a method for manufacturing the same. Further, another object of the present invention is, by using such an inductance element, to provide a snubber of which characteristics and productivity are improved.

An inductance element of the present invention comprises a coil provided with winding of which number of turns (N) per unit length of 10 mm is 20 or more and 500 or less, the winding having a hollow portion opened at both ends thereof, and a core having single or a plurality of layers of magnetic ribbon of a thickness of 4 $\mu$m or more and 50 $\mu$m or less and a width of 2 mm or more and 40 mm or less, at least part of the magnetic ribbon being disposed in the hollow portion, here a ratio (N/n) of the number of turns of the coil (N) to the number of layers of the soft magnetic ribbon (n) being 20 or more and 500 or less.

The inductance element of the present invention is obtained based on the following new knowledge. That is, by forming the winding of a coil in a cylinder opened at both ends thereof one hand, by sufficiently increasing the number of turns on the other hand, even when a cross section of a magnetic ribbon constituting the core is very small, sufficient inductance characteristics can be obtained. Based on such knowledge, in the present invention, a ratio (N/n) of the number of turns of the coil (N) to the number of layers of a magnetic ribbon (n) of a thickness of 4 $\mu$m or more and 50 $\mu$m or less is set at 20 or more and 500 or less. According to such inductance element, excellent characteristics particularly as a saturable inductor can be obtained.

In the inductance element of the present invention, different from the existing toroidal shape, a winding opened at both ends thereof is applied. Accordingly, compared with the inductance element of the existing toroidal shape, the processing efficiency in the step of winding can be remarkably improved. In specific, the step of coil winding can be easily automated. Thereby, the manufacturing cost of the inductance element can be remarkably lowered. In addition to these, based on the aforementioned N/n ratio, excellent inductance characteristics can be obtained.

As a specific mode of the inductance element of the present invention, a structure can be cited where a cylindrical bobbin having a hollow portion is used, around an external periphery thereof the winding being implemented, a magnetic ribbon being inserted in the hollow portion of the cylindrical bobbin. In an element using such a bobbin, when one end of the hollow portion is closed, the magnetic ribbon can have an open magnetic circuit structure. Further, when the both ends of the hollow portion are opened, by disposing the magnetic ribbon penetrating through the hollow portion thereof and by magnetically connecting the both ends thereof, the magnetic ribbon can have a closed magnetic circuit structure (closed magnetic circuit loop). Thus, the inductance element of the present invention can take various kinds of modes.

Further, another inductance element of the present invention comprises a coil provided with a winding having a hollow portion opened at both ends thereof and a core having single or a plurality of layers of magnetic ribbon of a thickness of 4 $\mu$m or more and 50 $\mu$m or less, the magnetic ribbon being disposed, so as to form a closed magnetic circuit structure, penetrating the hollow portion, the both ends thereof being magnetically connected.

A method of manufacturing a first inductance element of the present invention comprises the steps of disposing a winding around an external periphery of a bobbin having a hollow portion, disposing a magnetic ribbon in the hollow portion of the bobbin, disposing a lead terminal to the bobbin and electrically connecting an end portion of the winding to the lead terminal, and sealing the hollow portion therein the magnetic ribbon is disposed.

A method of manufacturing a second inductance element of the present invention comprises the steps of disposing a winding to a bobbin having a hollow portion opened at both ends thereof, disposing a magnetic ribbon penetrating in the hollow portion of the bobbin and magnetically connecting both ends of the magnetic ribbon, and disposing a lead terminal to the bobbin and electrically connecting an end of the winding to the lead terminal.

The inductance element of the present invention such as mentioned above has excellent characteristics as a current delay element of a snubber of for instance a switching power source. A snubber of the present invention comprises an inductance element of the present invention like this. In the snubber, an inductance element of the present invention is connected to a driver of a switching element to use.

DESCRIPTION OF THE PREFERRED EMBODIMENTS

In the following, modes for carrying out the present invention will be described.

Figure 1A:
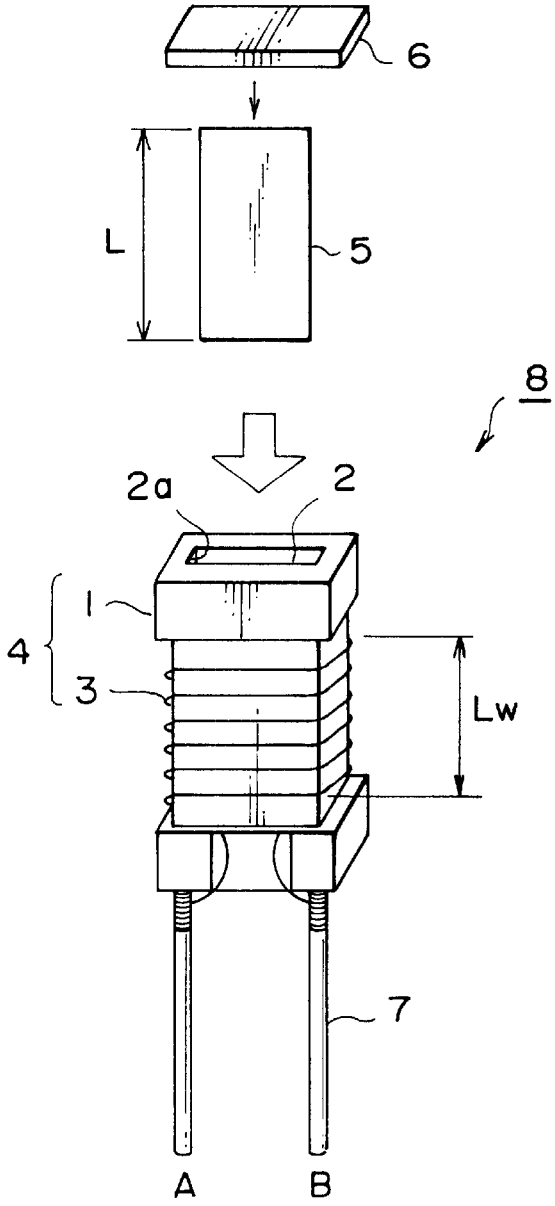
FIG. 1A is a perspective view in assembling steps showing schematically a structure of an inductance element according to a first embodiment of the present invention.
Figure 1B:
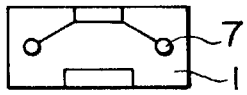
FIG. 1B is a bottom view of an inductance element shown in FIG. 1A.
Figure 2:
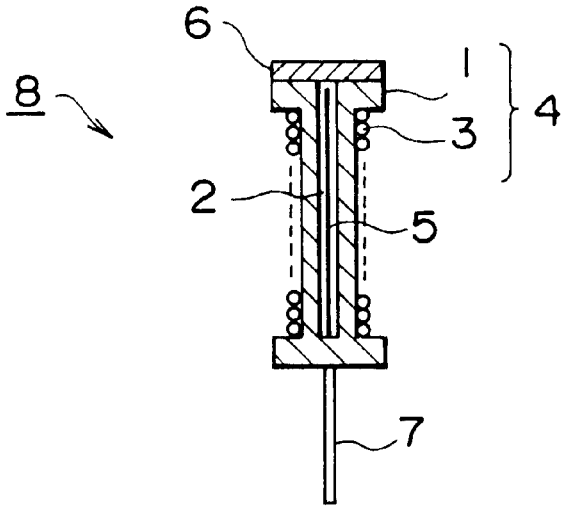
FIG. 2 is a cross section of the inductance element shown in FIG. 1A.
Figure 3:
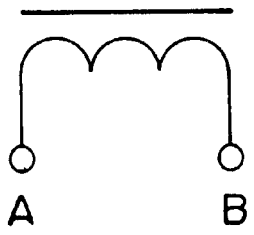
FIG. 3 is an equivalent circuit diagram of the inductance element shown in FIG. 1A.

FIGS. 1A and 1B are diagrams showing a configuration of an inductance element according to a first embodiment of the present invention. FIG. 1A shows a structure in assembling steps of an inductance element, FIG. 1B being a bottom view thereof. FIG. 2 is a cross section of the inductance element shown in FIG. 1A, FIG. 3 being an equivalent circuit diagram of the inductance element shown in FIG. 1A.

In these diagrams, reference numeral 1 denotes a cylindrical bobbin having a hollow portion 2, the bobbin 1 being constituted of insulator. For constituting material of the bobbin 1, if insulation and thermal resistance can be secured, various kinds of insulating materials can be used, for instance phenolic resin being used. Besides the phenolic resin, liquid crystal resin can be preferably used as constituting material of the bobbin 1.

The bobbin 1 shown in FIG. 1 is rectangular in its cross section, having the hollow portion 2 according to a shape of the bobbin 1. The bobbin 1 can be formed in ellipse or in circle. The hollow portion 2 disposed to the bobbin 1 is opened at one end thereof, the other end being closed.

The open side end (an opening) 2*a* of the hollow portion 2 needs only a space for inserting a magnetic ribbon that will be described later, the shape and size thereof being not particularly restricted. As the shape of the opening 2*a*, owing to an easiness of inserting the magnetic ribbon in the hollow portion 2, for instance a rectangular slit is preferably used. In view of handling during manufacturing and of prevention of the fall of the magnetic ribbon, the opening 2*a* is preferable to be disposed at other surface than a bottom surface of the bobbin 1. The bobbin 1 can be provided with a groove for fixing the magnetic ribbon or the coil winding, and can be impregnated with resin to fix.

On an external periphery of the bobbin 1, the winding 3 is disposed, therefrom the coil 4 being constituted. For the winding 3, for instance insulation-sheathed wire can be used. Such winding 3 is wound around the external periphery of the bobbin 1 so that the number of turns (N) per 10 mm length of the coil 4 is 20 or more and 500 or less.

In such coil 4, when the number of turns (N) per a length of 10 mm is less than 20, in the case where a magnetic ribbon very small in its cross section constituting a core is used as a core, sufficient inductance characteristics can not be obtained. On the other hand, when the number of turns (N) per a length of 10 mm exceeds 500, the density of the winding 3 becomes too high, that causing an increase of stray capacitance between the windings 3 to result in deterioration of the inductance characteristics.

The winding 3, by winding around the external periphery of the cylindrical bobbin 1 having the hollow portion 2, practically forms a hollow structure opened at both ends. That is, the winding constitutes a solenoid coil 4. A length between both ends of the winding 3 is set at $L_w$. Such winding 3, different from the existing toroidal shape, for instance by rotating the bobbin 1 to wind, can be easily formed through automation. That drastically improves an efficiency of the winding step.

In the hollow portion 2 of the bobbin 1 given the aforementioned winding 3, a magnetic ribbon 5 constituting a core of the coil 4 is inserted to dispose. The magnetic ribbon 5 disposed in the hollow portion 2 has an open magnetic circuit structure. A length of the magnetic ribbon 5 having the open magnetic circuit structure is set at L.

The magnetic ribbon 5 is formed in a thickness of 40 μm or more and 50 μm or less and a width of 2 mm or more and 40 mm or less. When the thickness of the magnetic ribbon 5 exceeds 50 μm, an eddy-current loss or the like increases to result in an increase of loss particularly in higher frequency region. When the thickness of the magnetic ribbon 5 is made less than 4 μm, easiness to produce deteriorates, surface smoothness deteriorating, pin holes tending to increase. The thickness of the magnetic ribbon 5 is further preferable to be in the range of 10 μm or more and 30 μm or less. By setting the width of the magnetic ribbon 5 in the aforementioned range, inconveniences such as folding or the like during for instance bobbin insertion become less. Thereby, handling becomes easy to result in an improvement of manufacturing efficiency and an inductance element of less high frequency loss.

According to the present invention, the magnetic ribbon 5, though can sufficiently exhibit an effect with a single layer, can be stacked in a plurality of layers to use. When a plurality of layers of the magnetic ribbon 5 is used, the shape of individual magnetic ribbon 5 is in the range of the aforementioned values. The magnetic ribbon 5 disposed in the hollow portion 2, as shown in FIG. 1A, may be planar, or can be modified so as to conform to the shape of the hollow portion 2.

In the inductance element of the present invention, a ratio (N/n) of the number of turns (N) per a length of 10 mm of the coil 4 to the number of stacking layers (n) of the magnetic ribbon 5 is set in the range of 20 or more and 500 or less. By setting the relationship between the number of turns (N) of the coil 4 and the number of stacking layers (n) of the magnetic ribbon 5 in the aforementioned range of the N/n ratio, even when such magnetic ribbon 5 of a thickness of 40 μm or more and 50 μm or less is used in a single layer, sufficient inductance characteristics can be obtained.

That is, when the N/n ratio is less than 20, in the present inductance element in which the magnetic ribbon 5 of small cross section is a core, sufficient inductance characteristics can not be obtained. On the other hand, when the N/n ratio exceeds 500, the large density of the winding 3 necessitates overlapping winding to cause an increase of stray capacitance between the windings 3, resulting in deterioration of impedance of the element. The N/n ratio is more preferable to be 20 or more and 250 or less.

The number of stacking layers (n) of the magnetic ribbon 5, when satisfying the aforementioned range of N/n ratio, is not particularly restricted. However, in view of the downsizing of the inductance element, it is preferable to be three layers or less. When the magnetic ribbon 5 is used in a single layer, the number of stacking layers (n) is naturally 1.

In the present inductance element, in addition to the aforementioned N/n ratio, a ratio (N/t) of the number of turns (N) per a length of 10 mm of the coil 4 to a thickness (t: μm) of the magnetic ribbon 5 is preferable to be 1 or more and 100 or less [/μm]. By satisfying such a relationship, more excellent inductance characteristics can be obtained. When a plurality of layers of magnetic ribbon 5 is stacked to use, the thickness (t) is a summation of those of the plurality of layers.

That is, when the N/t ratio is less than 1, in the present inductance element in which the magnetic ribbon 5 of small cross section is a core, sufficient inductance characteristics are difficult to secure. On the other hand, when the N/t ratio exceeds 100, the density of the winding 3 becomes such large as to necessitate to overlap, thereby the stray capacitance between the windings 3 increasing to result in deterioration of the inductance of the element. The N/t ratio is further preferable to set at 3 or more and 20 or less [/μm].

Further, when the magnetic ribbon 5 has an open magnetic circuit structure, a ratio ($L/L_w$) of the, length (L) of the magnetic ribbon and the length ($L_w$) of the winding 3 of the coil 4 is preferable to be in the range of 0.7 or more and 1.6 or less. When the $L/L_w$ ratio is less than 0.7, sufficient inductance characteristics may not be secured. On the other hand, even when the ratio $L/L_w$ is increased to exceed 1.6, not only the effect more than that can not be obtained but also a minus effect due to stray magnetic flux or the like may be caused. The $L/L_w$ ratio is further preferable to be 0.8 or more and 1.2 or less.

For constitutional material of the magnetic ribbon 5, various kinds of soft magnetic materials such as crystalline soft magnetic alloys, amorphous soft magnetic alloys, soft magnetic alloys having microcrystalline structure (hereinafter referred to as microcrystalline soft magnetic alloys) can be applied. Among these, in the present invention, particularly amorphous soft magnetic alloys and microcrystalline soft magnetic alloys are preferable.

As the crystalline soft magnetic alloys, for instance permalloy can be cited. In specific, permalloy containing 55 to 85% by weight of Ni, 7% by weight or less of Mo, 2 to 27% by weight of Cu, and the rest essentially consisting of Fe can be preferably used. The magnetic ribbon 5 consisting of the permalloy is formed in an alloy sheet due to for instance melting method, followed by hot rolling and cold tolling to be a ribbon of a prescribed thickness (4 to 50 μm). The obtained ribbon is controlled in magnetic characteristics due to magnetic heat treatment.

When the magnetic ribbon 5 is constituted of amorphous soft magnetic alloy, Co based amorphous alloys, Fe based amorphous alloys, Fe—Ni based amorphous alloys or the like can be preferably used. As the Co based and Fe based amorphous alloys, alloys of which compositions are essentially expressed by the following general formula can be cited.

General formula:

$$(M_{1-a}M'_a)_{100-X}X_X$$

(in the formula, M denotes at least one kind of element selected from Fe and Co, M' denotes at least one kind of element selected from Ti, V, Cr, Mn, Ni, Cu, Zr, Nb, Mo, Ta and W, X denotes at least one kind of element selected from B, Si, C and P, and a and X are numbers satisfying $0 \leqq a \leqq 0.5$, $10 \leqq X \leqq 35$ atomic %, respectively).

The composition ratio of Fe and Co as the M element are controlled according to necessary magnetic characteristics such as magnetic flux density, iron loss, sensitivity to a weak current or the like. The M' element is added to control thermal stability, corrosion resistance, crystallization temperature or the like. In particular, Cr, Mn, Zr, Nb and Mo can be preferably used. The X element is an element indispensable in obtaining amorphous alloy. B is an element effective in obtaining amorphous alloy, Si being an element effective in enhancing formation of amorphous phase and in raising crystallization temperatures.

Further, as the Fe—Ni based amorphous alloys, alloys of which compositions are essentially expressed by the following general formula can be cited.

General formula:

$$(Ni_{1-b}Fe_b)_{100-y-z-w}M''_ySi_zB_w$$

(in the formula, M" denotes at least one kind of element selected from V, Cr, Mn, Co, Nb, Mo, Ta, W and Zr, and b, y, z and w are numbers satisfying $0.2 \leqq b \leqq 0.5$, $0.05 \leqq y \leqq 10$ atomic. %, $4 \leqq z \leqq 12$ atomic %, $5 \leqq w \leqq 20$ atomic %, and $15 \leqq z+w \leqq 30$ atomic %, respectively).

The Fe—Ni based amorphous alloys, with Ni rich Fe—Ni base, in addition to being excellent magnetic characteristics, enable to be manufactured less expensive than the aforementioned Co based amorphous alloys. The M" element is added to control thermal stability, corrosion resistance and crystallization temperatures, particularly preferable to use Cr, Mn, Co and Nb.

The magnetic ribbon 5 consisting of the amorphous soft magnetic alloy is manufactured by use of for instance liquid quenching method. In specific, alloy raw material adjusted to a prescribed composition ratio is quenched from a molten state with a cooling rate of $10^{5°}$ C./sec or more to obtain. By use of such liquid quenching method, an amorphous alloy ribbon of a thickness in the range of 4 to 50 $\mu$m can be obtained. The thickness of the amorphous alloy ribbon is preferable to be 25 $\mu$m or less, further preferable to be in the range of 8 to 20 $\mu$m. By controlling the thickness of the ribbon, a core of low loss can be obtained.

As the microcrystalline soft magnetic alloys to be applied in the magnetic ribbon 5, one consisting of Fe based alloy of which composition is essentially expressed by the following general formula and having fine grains of which average grain diameter is for instance 50 nm or less can be cited.

General formula:

$$Fe_{100-c-d-e-f}Cu_cA_dSi_eB_f$$

(in the formula, A denotes at least one kind of element selected from Ti, Zr, Hf, V, Nb, Ta, Cr, Mo, W, Mn, Ni, Co and Al, and c, d, e and f are numbers satisfying $0.01 \leqq c \leqq 4$ atomic %, $0.01 \leqq d \leqq 10$ atomic %, $10 \leqq e \leqq 25$ atomic %, $3 \leqq f \leqq 12$ atomic %, and $17 \leqq e+f \leqq 30$ atomic %, respectively).

Here, Cu is an element effective, in addition to improving corrosion resistance and preventing grains from becoming coarse, in improving soft magnetic characteristics such as iron loss and permeability. The A element is an element effective in obtaining uniform grain diameter, lowering magnetostriction and magnetic anisotropy, improvement of magnetic characteristics with respect to temperature variation, or the like. The microcrystalline structure is preferable to take a mode in which grains of a grain diameter particularly in the range of 5 to 30 nm exist in the alloy with an area ratio of 50 to 90%.

The magnetic ribbon 5 consisting of the Fe based microcrystalline soft magnetic alloy can be obtained by manufacturing an amorphous alloy ribbon due to for instance liquid quenching method, followed by heat treating at a temperature in the range of −50 to +120° C. relative to the crystallization temperature thereof for 1 min to 5 hours to precipitate microcrystallites, or by controlling the cooling rate of the liquid quenching method to directly precipitate microcrystallites. By heat treating such microcrystalline soft magnetic alloy ribbon while applying a magnetic field in a direction of width thereof, a prescribed direct current squareness can be obtained.

Figure 4:
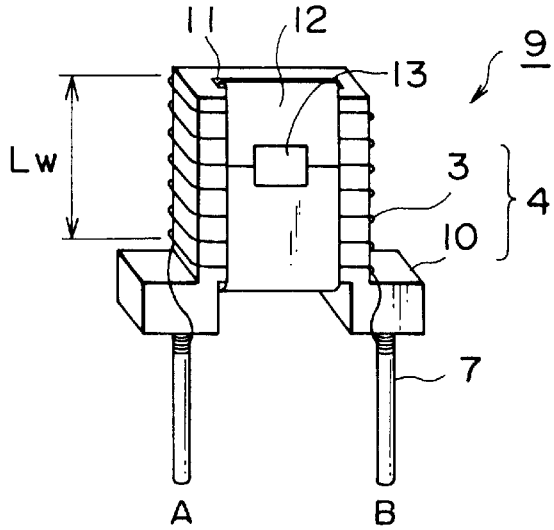
FIG. 4 is a perspective view showing schematically a structure of an inductance element according to a second embodiment of the present invention.

The constituting materials of the magnetic ribbon 5 can be used appropriately selecting according to the usage of the inductance element. For instance, to obtain a saturable inductor of high permeability, the Co based amorphous soft magnetic alloy can be preferably used. Further, to obtain a small size smoothing choke coil, the Fe based microcrystalline soft magnetic alloy and Fe based amorphous soft magnetic alloy can be preferably used. In addition, by employing the magnetic ribbon 5 without heat treating, the magnetic ribbon 5 can be prevented from becoming brittle. By preventing from becoming brittle, when applied in the closed magnetic circuit structure for instance such as shown in FIG. 4, the magnetic ribbon 5 can be reduced in being damaged.

The magnetic ribbon 5 such as mentioned above is disposed inside of the hollow portion 2 of the bobbin 1. Since one end of the hollow portion 2 is closed, the magnetic ribbon 5 is held by the hollow portion 2. The opening 2*a* of the hollow portion 2 is sealed by for instance a cap 6. The cap 6 is fixed to the bobbin 1 due to thermal fusion, adherence or the like. The cap 6 may be fixed by use of snap. Further, instead of the use of the cap 6, it can be sealed with resin or the like. Thus, by sealing the opening 2*a* of the hollow portion 2 therein the magnetic ribbon 5 is disposed, the magnetic ribbon 5 can be fixed and protected. Thereby, characteristics of the inductance element can be stabilized.

On the end surface opposite to the opening 2*a* of the bobbin 1, a lead terminal 7 is disposed. For the lead terminal 7, two pieces of for instance solder plated conductors are used. A pitch of the lead terminal 7, so as to be inserted in an ordinary electronic substrate, is set at for instance 7.62 mm. The lead terminal 7, considering to be fixed on a printed circuit board, can be given a third lead. A position to form the lead terminal 7, without restricting to the surface opposite to the opening 2*a* of the. hollow portion 2, can be set to the other portion as demands arise.

To the aforementioned two pieces of lead terminals 7, ends of the winding 3 are electrically connected respectively. The ends of the winding 3, after stripping the sheath, are bonded to the lead terminals 7 due to for instance solder bonding. From the aforementioned respective constituent elements, the present inductance element 8 is constituted.

In the inductance element 8 of the present embodiment, the coil 4 is constituted by coiling the winding 3 around the external periphery of the cylindrical bobbin 1. Accordingly, compared with the existing toroidal inductance, processing efficiency in coiling the winding 3 can be remarkably improved. Further, the coiling step of the coil 4 can be easily automated. Thereby, the manufacturing cost of the inductance element 8 can be remarkably reduced.

In addition, based on the aforementioned N/n ratio and N/t ratio, despite the magnetic ribbon 5 of which cross-section is very small is used as the core, the inductance element 8 possesses sufficient inductance characteristics. In particular, according to the inductance element 8, excellent characteristics as a saturable inductor can be obtained. Such inductance element 8 can be preferably applied in for instance a current delay element of a snubber of a switching power source. Further, on the bobbin 1 the lead terminal 7 conformed to the connecting terminal of the substrate is disposed. As a result, productivity of a step of mounting the inductance element 8 on the substrate can be improved.

In the aforementioned embodiment, a configuration having the coil 4 in which the winding 3 is wound around the bobbin 1 is explained. However, the present inductance element 8 is not restricted thereto. For instance, by winding insulated sheathed wire capable of self-fusing, a solenoid coil is manufactured in one body. Thereafter, by disposing the magnetic ribbon in the hollow portion of the coil as core, the present inductance element can be constituted.

The aforementioned inductance element 8 can be manufactured for instance in the following ways.

First, around the external periphery of the bobbin 1 having the hollow portion 2, the winding 3 is disposed so that the number of turns (N) per a length of 10 mm is 20 or more and 500 or less. The step of winding can be automated. The specific number of turns (N) of the winding 3, according to the thickness (t) of the magnetic ribbon 5 being used, is set so that a ratio (N/n) of the number of turns (N) and the number of stacking layers of the magnetic ribbon 5 becomes 20 or more and 500 or less.

Next, in the hollow portion 2 of the bobbin 1, the magnetic ribbon 5 is disposed. Further, the lead terminal 7 is given to the bobbin 1. To the lead terminal 7, the end of the winding 3 is electrically connected. Thereafter, the opening 2*a* of the hollow portion 2 therein the magnetic ribbon 5 is disposed is sealed with for instance the cap 6. Thus, the inductance element 8 can be obtained.

According to such manufacturing process of the inductance element 8, after implementing for instance an automated winding step, the magnetic ribbon 5 can be inserted into the hollow portion 2 of the bobbin 1 to obtain the core. Accordingly, the manufacturing steps can be remarkably efficiently implemented. That is, the manufacturing cost of the inductance element 8 can be largely decreased. In the existing inductance element using a toroidal core, after formation of the toroidal core, the winding to the toroidal core is indispensable, the present invention can eliminate such an inefficient winding step.

Next, an inductance element according to a second embodiment of the present invention will be described.

Figure 5:
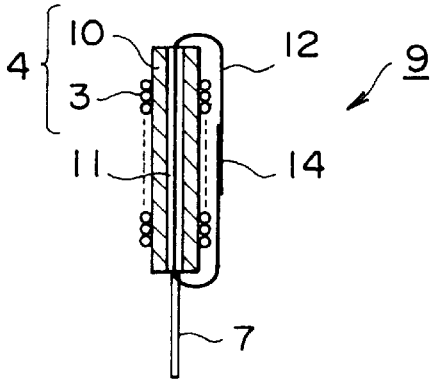
FIG. 5 is a cross section of the inductance element shown in FIG. 4.
Figure 6:
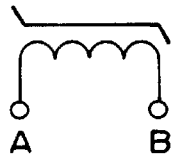
FIG. 6 is an equivalent circuit diagram of the inductance element shown in FIG. 4.

FIG. 4 is a perspective view showing a structure of an inductance element of the second embodiment. FIG. 5 is a sectional view of the inductance element shown in FIG. 4, FIG. 6 being an equivalent circuit diagram of the inductance element shown in FIG. 4.

In an inductance element 9 shown in these diagrams, a bobbin 10 has a hollow portion 11 opened at both ends. Around an external periphery of the bobbin 10, similarly with the aforementioned first embodiment, winding 3 is given. A magnetic ribbon 12 is disposed penetrating the hollow portion 11 of the bobbin 10, both ends of the magnetic ribbon 12 being magnetically connected outside of the bobbin 10. That is, the magnetic ribbon 12, through the hollow portion 11, forms a closed magnetic circuit loop involving part of the winding 3.

The detailed conditions of such as shape and constitutional material of the magnetic ribbon 12, the number of turns (N) per a length of 10 mm of the coil 4, the ratio (N/n) of the number of turns (N) of the coil 4 to the number of layers (n) of the magnetic ribbon 12 and the ratio (N/t) of the number of turns (N) of the coil 4 to the thickness (t) of the magnetic ribbon 12 are set similarly with those of the aforementioned first embodiment. Further, to the bobbin 10, similarly with the first embodiment, a lead terminal 7 is disposed, each end of the winding 3 being electrically connected to the lead terminal 7.

Both ends of the magnetic ribbon 12 are connected to form a closed magnetic circuit loop. The interconnection is carried out in the following way. For instance, a front surface of one end of the magnetic ribbon 12 and a rear surface of the other end thereof are stacked to partly overlap, the stacked portion being fixed by use of for instance a tape 13. For interconnecting both ends of the magnetic ribbon 12, when possible to constitute a closed magnetic circuit loop, various fixing methods can be used. For instance fixing due to an adherent or fixing due to welding, fusion and adhesive tape can be used. When two or more layers of magnetic ribbon 12 are used, the stacked magnetic ribbon 12 is inserted in the hollow portion 11, followed by connecting the both ends.

In the case of the magnetic ribbon 12 forming a closed magnetic circuit loop, when a length of one round of the loop like magnetic ribbon 12 of which both ends are connected is an average magnetic circuit length (Lc), so that a ratio (Lc/Lw) of the average magnetic circuit length (Lc) to the length (Lw) of the winding 3 of the coil 4 becomes 6 or less, the length of the magnetic ribbon 12 is preferable to be set. Even if the Lc/Lw ratio is made larger than 6, an improvement of inductance characteristics can not be obtained to result in useless use of the magnetic ribbon 12. A distance between the magnetic ribbon 12 and the winding 3 is better to be as small as possible.

Figure 7:
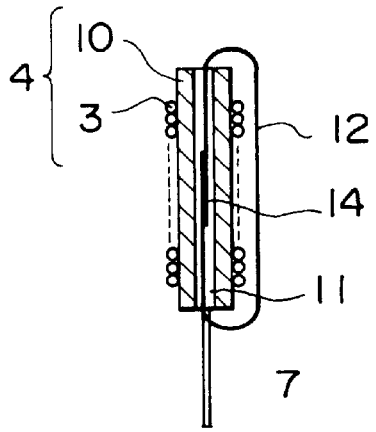
FIG. 7 is a cross section showing a first modification example of the inductance element according to the second embodiment of the present invention.
Figure 8:
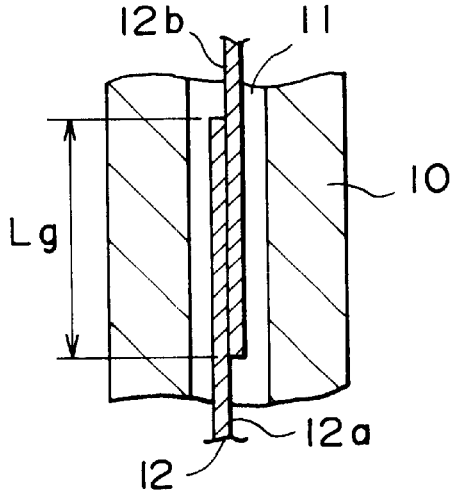
FIG. 8 is a cross section showing in enlargement an essential portion of the inductance element shown in FIG. 7.

A connecting portion 14 thereby the magnetic ribbon 12 forms a closed magnetic circuit loop, as shown in FIGS. 4 and 5, though can be disposed outside the bobbin 10, is preferable to be disposed, as shown in FIG. 7, inside the hollow portion 11 of the bobbin 10. As shown in FIG. 8, since the connecting portion 14 is constituted by stacking a front surface 12*a* of one end of the magnetic ribbon 12 and a rear surface 12*b* of the other end, at the connecting portion 14, a cross section of the magnetic ribbon 12 becomes two times. By disposing such a portion inside the hollow portion 11, inductance characteristics can be further improved.

That is, when an electric current is flowed through the solenoid type coil 4, generated magnetic field is largely affected by the inside of the coil 4. Accordingly, inside of the hollow portion 11 equivalent to the inside of the coil 4, by disposing the connecting portion 14 where the cross section of the magnetic ribbon 12 is two times, the inductance characteristics can be further improved.

The stacking length of the magnetic ribbon 12 at the connecting portion 14, in other words the length (Lg) of the connecting portion 14, is preferable to be 60% or less of the average magnetic circuit length (Lc) of the magnetic ribbon 12. When the length (Lg) of the connecting portion 14 is set too long, the coil 4 can be assembled with difficulties. On the other hand, in view of attaining the aforementioned improvement effect of the inductance characteristics, the length (Lg) of the connecting portion 14 is preferable to be 10% or more of the average magnetic circuit length (Lc) of the magnetic ribbon 12.

Figure 9:
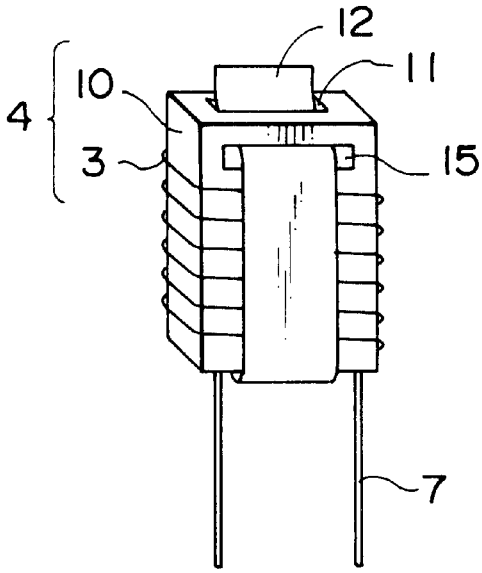
FIG. 9 is a perspective view showing a second modification example of the inductance element according to the second embodiment of the present invention.
Figure 10:
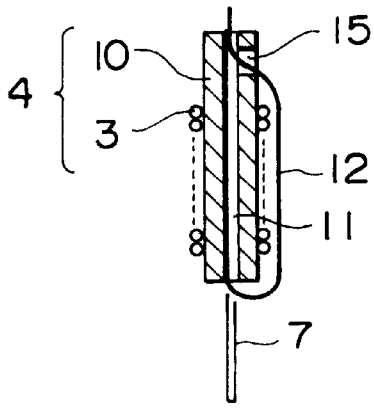
FIG. 10 is a cross section of the inductance element shown in FIG. 9.

A connection structure of the magnetic ribbon 12 for forming the closed magnetic circuit loop is not restricted to the structure where as shown in FIG. 4, the front and rear surfaces of the ends are stacked. FIGS. 9 and 10 show other connection structures of the magnetic ribbon 12. The bobbin 10 shown in these figures has, at one end side, a slit 15 connecting to the hollow portion 11. One end of the magnetic ribbon 12 is returned to the hollow portion 11 through the slit 15, both front surfaces of the ends of the magnetic ribbon 12 being magnetically connected to each other. Thus, the closed magnetic circuit loop can be formed. In this case, due to stress of the magnetic ribbon 12 a contact is maintained, accordingly the fixing due to an adhesive or the like can be eliminated.

Figure 11:
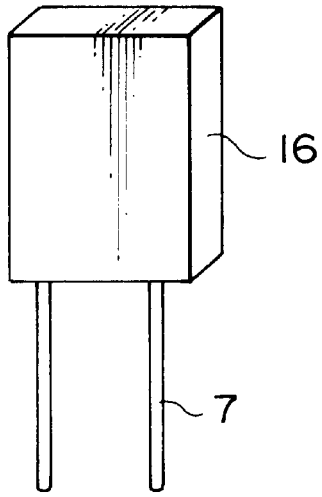
FIG. 11 is a perspective view showing a state accommodating in a case the inductance element according to the second embodiment of the present invention.

In the inductance element 9 having the magnetic ribbon 12 of the closed magnetic circuit structure, to maintain insulated from the external, it is preferable to accommodate, for instance as shown in FIG. 11, in a box type insulation case 16 or to apply resin sealing due to epoxy resin or the like.

The aforementioned inductance element 9 can be manufactured for instance in the following ways.

First, around the external periphery of the bobbin 10 having the hollow portion 11, the winding 3 is disposed so that the number of turns (N) per a length of 10 mm is 20 or more and 500 or less. The step of winding can be automated. The specific number of turns (N) of the winding 3, according to the thickness (t) of the magnetic ribbon 12 being used, is set so that a ratio (N/n) of the number of turns (N) to the number of stacking layers of the magnetic ribbon 12 becomes 20 or more and 500 or less.

Next, the magnetic ribbon 12 is caused to penetrate the hollow portion 11 of the bobbin 10, further outside the bobbin 10 both ends of the magnetic ribbon 12 being connected to form a closed magnetic circuit loop. The connection portion 14 of the magnetic ribbon 12 is preferable to be moved to locate inside the hollow portion 11 of the bobbin 10. Further, to the bobbin 10 the lead terminal 7 is disposed. To the lead terminal 7 the end portion of the winding 3 is electrically connected. Thereafter, the insulation case 16 or resin sealing is applied to secure insulation of the inductance element 9. Thus, the inductance element 9 can be obtained. In addition, various kinds of changes in the order of steps can be made. For instance, after previously disposing the lead terminal 7 to the bobbin 10, the winding can be implemented.

Even in the aforementioned inductance element 9 of the second embodiment, the winding 3 is disposed around the cylindrical bobbin 10 to constitute the coil 4. Accordingly, efficiency in the step of winding 3 can be remarkably improved. Further, the step of winding the coil 4 can be easily automated. Thereby, the manufacturing cost of the inductance element 9 can be remarkably lowered.

In addition to the above, based on the aforementioned N/n ratio and N/t ratio, despite of the use of the magnetic ribbon 12 of which cross section is very small as the core, sufficient inductance characteristics can be obtained. In particular, according to the inductance element 9, excellent characteristics as a saturable inductor can be obtained. Further, in the inductance element 9 of the second embodiment, the magnetic ribbon 12 is connected in a closed magnetic circuit loop. Thereby, interference with the other element can be previously prevented from occurring.

In addition, according to the aforementioned manufacturing steps of the inductance element 9, for instance after the automated winding step, the magnetic ribbon 12 can be inserted into the hollow portion 11 of the bobbin 10. As a result, the manufacturing steps can be remarkably improved in efficiency. That is, the manufacturing cost of the inductance element 9 can be decreased.

Next, an embodiment of a snubber of the present invention will be described.

Figure 12:
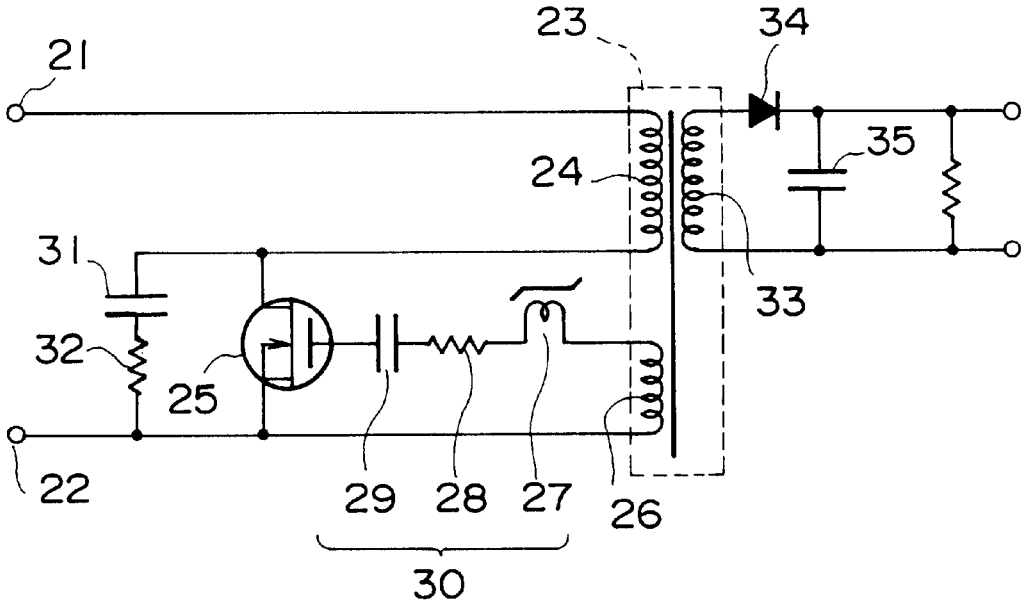
FIG. 12 is a circuit diagram showing one constitutional example of a switching power source therein a snubber of the present invention is applied.
Figure 13A:
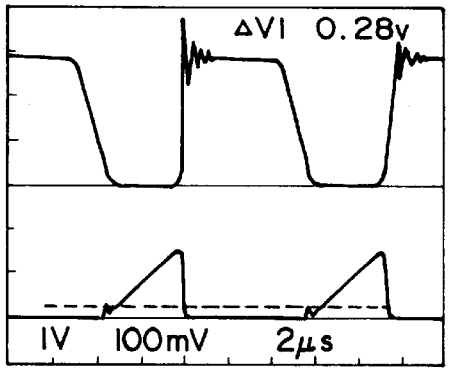
FIG. 13A to FIG. 13H are diagrams showing respectively waveforms of a voltage between gate-source of a FET and a drain current in a switching power source that uses each inductance element of Embodiments 1 to 4 of the present invention and comparative examples 1 to 4.
Figure 13B:
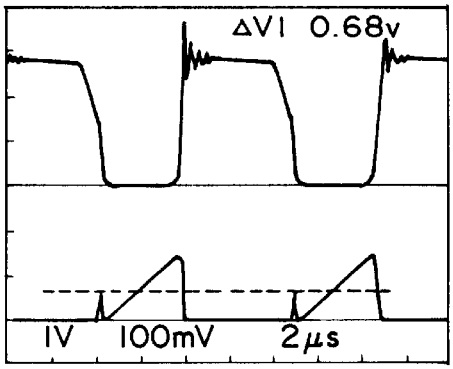
Figure 13C:
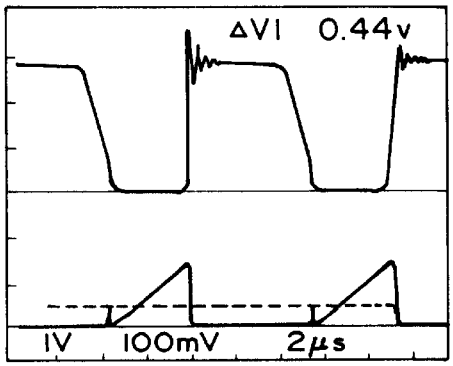
Figure 13D:
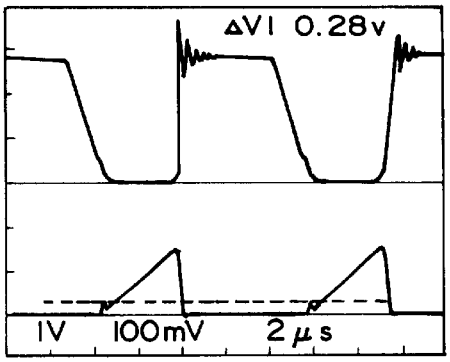
Figure 13E:
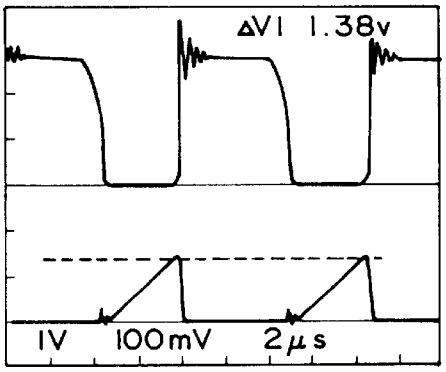
Figure 13F:
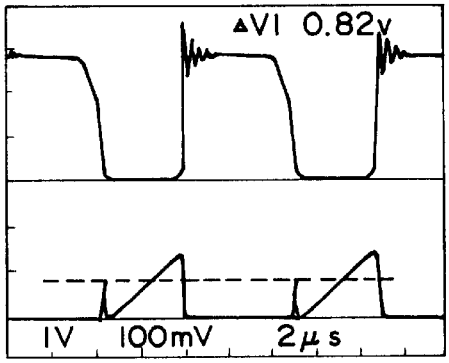
Figure 13G:
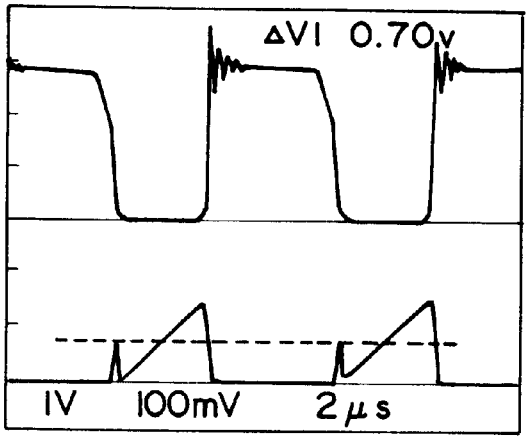
Figure 13H:
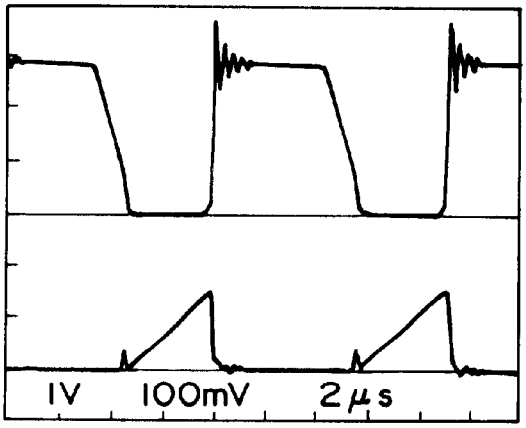
Figure 14A:
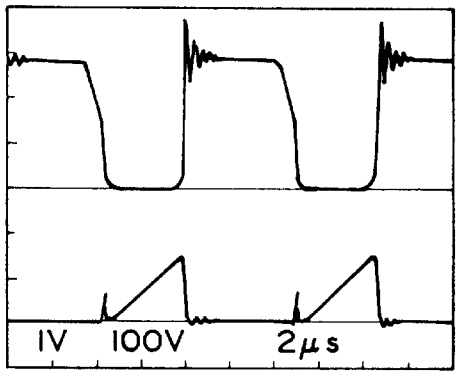
FIG. 14A to FIG. 14G are diagrams showing respectively waveforms of a voltage between gate-source of a FET and a drain current in a switching power source that uses each inductance element of Embodiments 5 to 9 of the present invention and comparative examples 5 to 6.
Figure 14B:
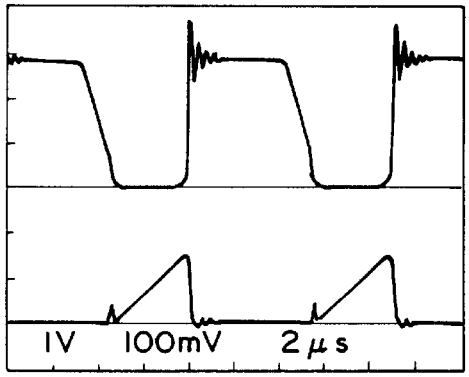
Figure 14C:
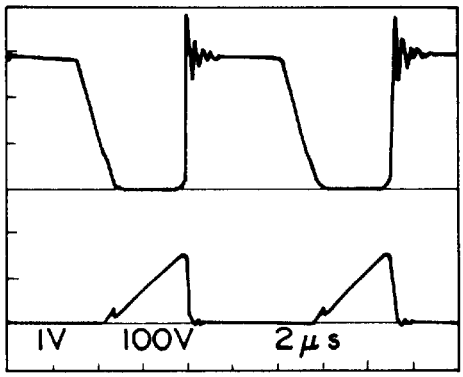
Figure 14D:
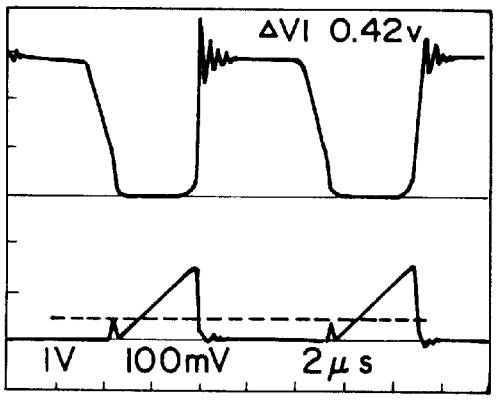
Figure 14E:
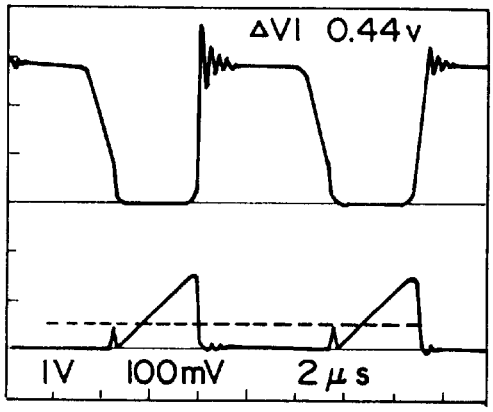
Figure 14F:
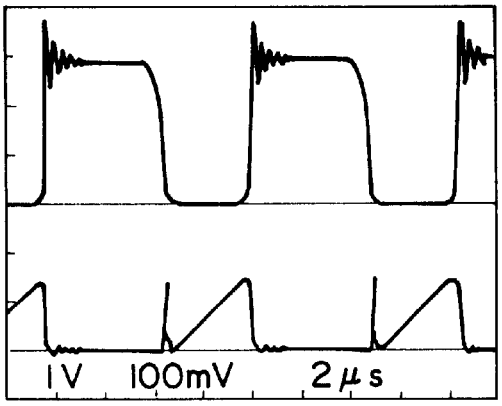
Figure 14G:
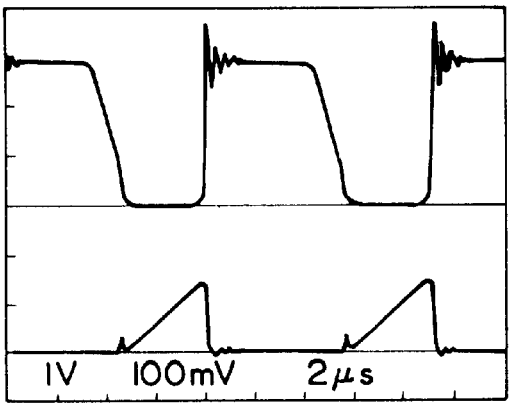

A snubber of the present invention comprises the aforementioned inductance element (8, 9) of the present invention, the inductance element (8, 9) being connected to a driver of a switching element to use. FIG. 12 is a circuit diagram showing one constitutional example of a switching power source of self-excited flyback type in which the present snubber is used.

In FIG. 12, between input terminals 21 and 22, a primary winding 24 of a transformer 23 and a FET 25 as a switching element are connected in series. To the transformer 23, as a driver of the FET 25, a winding 26 for driving a gate of the FET 25 is disposed. That is, the winding 26 is a positive feed back winding of the transformer 23 wound for self-exciting the FET 25. Between the gate of the FET 25 and the FET drive winding 26, a saturable inductor 27, a resistance 28 and a condenser 29 are connected in series to constitute a snubber 30.

The resistance 28 gives an appropriate drive current to the FET 25, the condenser 29 being arbitrarily connected to improve drive characteristics of the FET 25. These are preferable to be used connected in series with the saturable inductor 27. As the saturable inductor 27 in the snubber 30, the present inductance element (8, 9) can be used.

Between the primary winding 24 of the transformer 23 and the input terminal 22, a snubber condenser 31 is connected in series to absorb a surge voltage generated at the primary winding 24 of the transformer 23. Further, in series with the snubber condenser 31, a snubber resistance 32 is connected, a change rate di/dt of a charge current i being lowered. A secondary winding 33 side of the transformer 23 is similar with the existing switching power source, a rectifying element 34 and a condenser 35 being connected as an output smoothing circuit.

In the switching power source such as mentioned above, the saturable inductor 27 therein the present inductance element (8, 9) is applied functions effectively as a current delay element for delaying gate signal of the FET 25. Accordingly, the FET 25 can be excellently operated through zero voltage switching. Thereby, the decrease of the surge current of the FET 25 as the switching element and an improvement of efficiency as power source can be simply and effectively realized.

Next, concrete embodiments of the present invention and evaluated results thereof will be described.

EMBODIMENTS 1 TO 4, COMPARATIVE EXAMPLES 1 TO 4

First, as the bobbin 1 shown in FIG. 1A, one having a rectangular shape of a height 15 mm, a width 6 mm and a depth 1.5 mm and consisting of liquid crystal resin (liquid crystal polymer) is prepared. The bobbin 1 has the hollow portion 2 of which shape of the opening 2*a* is 5×0.3 mm and of which depth is 14 mm. Further, on an end surface of the bobbin 1 opposite to the opening 2a, two pieces of solder plated conductor of 0.6 mm square are pressed in to be the lead terminals 7. A pitch of the lead terminals 7 is 7.62 mm to be capable of inserting in an ordinary electronic substrate.

Around the aforementioned bobbin 1, urethane sheathed wire of a diameter of 0.1 mm is wound by 50 turns (Embodiment 1), 100 turns (Embodiment 2), 200 turns (Embodiment 3) and 100 turns (Embodiment 4) respectively to form the windings 3. The winding length Lw of the coil 4 is set at a definite value of 12 mm. The winding 3 of 200 turns is due. to halfway folding. These windings 3 are wound by rotating the bobbin 1, thereby easily automated. The both ends of the winding 3, after stripping off the sheathing, are solder bonded to the two pieces of lead terminal 7, respectively. In concrete, after hooking the end portion of the winding 3 to the lead terminal 7, these are immersed in a solder bath to melt the sheath, thereby being solder bonded.

gate-source voltage (100 v/div), a lower step a drain current (1 A/div). Source efficiencies are shown in Table 1 together with measurements of surge current.

TABLE 1

| | Number of Turns per 10 mm (N) | Magnetic Circuit | N/n Ratio | N/t Ratio | L/Lw Ratio | Element Volume ($mm^3$) | Surge Current Ipp (A) | Efficiency (%) |
|---|---|---|---|---|---|---|---|---|
| Embodiment 1 | 42 | Open | 42 | 2.3 | 1.0 | 161 | 0.28 | 87.5 |
| Embodiment 2 | 83 | Open | 83 | 4.6 | 0.3 | 161 | 0.68 | 85.7 |
| Embodiment 3 | 167 | Open | 167 | 9.3 | 0.6 | 161 | 0.44 | 86.8 |
| Embodiment 4 | 83 | Open | 83 | 4.6 | 2.0 | 162 | 0.28 | 87.2 |
| Comparative Example 1 | (No Measure) | — | — | — | — | — | 1.38 | 85.5 |
| Comparative Example 2 | (Ferrite Beads) | Closed | — | — | — | 86 | 0.82 | 84.8 |
| Comparative Example 3 | (Ferrite Rod) | Open | — | — | — | 166 | 0.70 | 84.4 |
| Comparative Example 4 | (Toroidal Core) | Closed | — | — | — | 160 | 0.36 | 87.9 |

Next, as the magnetic ribbon 5, a Co based amorphous alloy ribbon of a thickness of 18 $\mu$m and a width of 4.5 mm is prepared, being used by a single layer. The length L of the magnetic ribbon 5 is set the same with the winding length Lw in Embodiment 1, that being inserted in the hollow portion 2 from the opening 2*a* of the bobbin 1. In Embodiment 2, the length L of the magnetic ribbon 5 is set 0.3 times the winding length Lw, in Embodiment 3 the length L of the magnetic ribbon 5 being set 0.6 times the winding length Lw, and in Embodiment 4 the length L of the magnetic ribbon 5 being set 2 times the winding length Lw, each being inserted in the hollow portion 2 from the opening 2*a* of the bobbin 1. In Embodiments 1 to 3, the opening 2*a* is closed with the cap 6 consisting of insulator, followed by welding. In Embodiment 4, the length of the magnetic ribbon being long, the opening is not capped to use.

The respective inductance elements of the aforementioned Embodiments 1 to 4 are used as the saturable inductor 27 of the switching power source shown in FIG. 12, characteristics as the delay element being measured and evaluated. In concrete, under an input of 140 vDC and a load condition of 24 v, 1.5 A, delay effect and source efficiency of each element are observed.

As Comparative Example 1 of the present invention, characteristics of a switching power source in which an inductance element is not inserted is measured and evaluated similarly with the embodiment. Further, in Comparative Example 2 an inductor in which to toroidal ferrite beads (4×1.5×6 mm) 8 turns of winding is given is used, in Comparative Example 3 a linear inductor in which to a rod-shaped ferrite 50 turns of winding is given is used, and in Comparative Example 4 a Co based amorphous alloy ribbon is wound in a cylinder of an external diameter of 4 mm, an internal diameter of 2 mm and a height of 6 mm, that being accommodated in an insulation case to form a toroidal core, thereto 6 turns of winding being given to form a saturable inductor, the saturable inductor being used. These are measured and evaluated similarly with the embodiments.

Measurements are shown in FIGS. 13A to 13H and Table 1. Situation of surge current suppression, by observing waveforms of a voltage between gate-source of a FET and a drain current thereof, is shown in FIGS. 13A through 13H, respectively. In FIGS. 13A to 13H, an upper step shows a As obvious from FIGS. 13A to 13H and Table 1, when the inductance elements of the present embodiments are used, the surge currents are remarkably reduced compared with Comparative example 1 where no measures are taken, source efficiencies being confirmed to improve. The present inductance elements, while having the structures that can remarkably improve productivity compared with Comparative Example 4 that is an existing closed magnetic circuit core, in comparison with Comparative Example 4, have approximately equal element volume and show similar noise suppression effect. Among these, Embodiment 1, in view of the surge suppression effect and the efficiency together, is superior to Comparative Example 4.

Further, Embodiment 4 where the length L of the magnetic ribbon is set twice the winding length Lw shows a surge suppression effect similar with Embodiment 1, the efficiency being approximately equal but a little bit lower. From this, it is obvious that even if the length L of the magnetic ribbon is made longer than the necessary one, the surge suppression effect remains approximately the same, the efficiency being equal or a little bit lower. Accordingly, considering, in addition to an increase of an amount of use of the magnetic ribbon, minus effects such as likelihood of an increase of stray magnetic flux, the length L of the magnetic ribbon is preferable to be 0.7 to 1.5 times the winding length.

The inductance element of the present invention, though different from the existing toroidal structure and formed in a closed magnetic circuit, sufficiently functions as the current delay element. According to the present invention, the winding step can be automated, as a result productivity of the inductance element can be largely improved. Further, owing to the lead terminal, due to tape carrier packaging the substrate assemblage can be automated.

Here, weights of the inductance elements of Embodiment 1 and Comparative Example 4 both having the identical characteristics (efficiencies) are measured. The element of Embodiment 1 is 0.343 g, that of Comparative Example 4 being 0.550 g, that is approximately 38% light-weighting. Thus, the present inductance element shows approximately identical characteristics with those of the existing one, and being sufficiently lightweight. The present invention is also effective in realizing to be light-weight.

EMBODIMENTS 5 TO 9, COMPARATIVE EXAMPLE 5 TO 6

First, as the bobbin 10 shown in FIG. 4, one having a rectangular shape of a height 13 mm, a width 6 mm and a depth 1.5 mm and consisting of liquid crystal resin (liquid crystal polymer) is prepared. The bobbin 10 has the hollow portion 11 of rectangular cross section of 5×0.3 mm opened at both ends thereof. Further, on a bottom surface of the bobbin 10, two pieces of solder plated conductor of 0.6 mm square are pressed in to be the lead terminals 7. A pitch of the lead terminals 7 is 7.62 mm to be capable of inserting into an ordinary electronic substrate.

Around the aforementioned bobbin 10, urethane sheathed wire of a diameter of 0.1 mm is wound by 50 turns (Embodiment 5), 100 turns (Embodiment 6), 200 turns (Embodiment 7), 100 turns (Embodiment 8) and 100 turns (Embodiment 9) respectively to form the windings 3. The winding length Lw of the coil 4 of Embodiment 5 is set 8 mm. The winding lengths Lw of the coils 4 of Embodiment 6 to 9 are 12 mm respectively. The winding 3 of 200 turns is due to halfway folding. These windings 3 are wound by rotating the bobbin 10, thereby easily automated. The both ends of the winding 3, after stripping off the sheathing, are solder bonded to the two pieces of lead terminal 7, respectively.

Next, as the magnetic ribbon 12, a Co based amorphous alloy ribbon of a thickness of 18 $\mu$m and a width of 4.5 mm is prepared, being used in a single layer. The Co based amorphous alloy ribbon is inserted penetrating into the hollow portion, being formed in loop, followed by stacking the both ends of the alloy ribbon, the stacked portion being fixed with a tape 13. The average magnetic circuit lengths Lc of the magnetic ribbons 12 of Embodiment 5, Embodiment 6 and Embodiment 7 are 27 mm respectively, that of Embodiment 8 being 64 mm, that of Embodiment 9 being 101 mm. The length of the stacked portion of the magnetic ribbon is 9 mm, respectively.

The respective inductance elements of the aforementioned Embodiments 5 to 9 are used as the saturable inductor 27 of the switching power source shown in FIG. 12, characteristics as the delay element being measured and evaluated. The measurement conditions are identical with those of Embodiment 1.

As Comparative Example 5 of the present invention, characteristics of a switching power source in which an inductance element is not inserted are measured and evaluated similarly with the embodiment. Further, a Co based amorphous alloy ribbon is wound to be an external diameter 4 mm, an internal diameter 2 mm and a height 6 mm, that being accommodated in an insulation resin case to be a toroidal core, around that 8 turns of winding being given to form a saturable inductor. This saturable inductor is used in Comparative Example 6. These are measured and evaluated similarly with the embodiments.

Measurements are shown in FIGS. 14A to 14G and Table 2. Each suppression behavior of the surge current, by observing waveforms of a voltage between gate-source of a FET and a drain current thereof, is shown in FIGS. 14A through 14G, respectively. In FIGS. 14A to 14G, an upper step shows a gate-source voltage (100 v/div), a lower step a drain current (1 A/div). Source efficiencies are shown in Table 2 together with measurements of surge current.

TABLE 2

| | Number of Turns per 10 mm (N) | Magnetic Circuit | N/n Ratio | N/t Ratio | L/Lw Ratio | Element Volume ($mm^3$) | Surge Current Ipp (A) | Efficiency (%) |
|---|---|---|---|---|---|---|---|---|
| Embodiment 5 | 42 | Closed | 42 | 2.3 | 3.38 | 143 | 0.66 | 88.2 |
| Embodiment 6 | 83 | Closed | 83 | 4.6 | 2.25 | 149 | 0.40 | 89.5 |
| Embodiment 7 | 167 | Closed | 167 | 9.3 | 2.25 | 161 | 0.28 | 89.8 |
| Embodiment 8 | 83 | Closed | 83 | 4.6 | 5.33 | 152 | 0.42 | 89.5 |
| Embodiment 9 | 83 | Closed | 83 | 4.6 | 8.42 | 155 | 0.44 | 89.4 |
| Comparative Example 5 | (No Measure) | — | — | — | — | — | 1.38 | 87.2 |
| Comparative Example 6 | (Toroidal Core) | Closed | — | — | — | 160 | 0.36 | 89.6 |

As obvious from FIGS. 14A to 14G and Table 2, the surge currents of Embodiments 5 to 9 are reduced compared with Comparative Example 5 where no measures are taken, source efficiencies being also improved. Even relative to Comparative Example 6 that is the existing inductance element, despite of the smaller element size, approximately comparable suppression effect is shown. Embodiment 7 is superior in the surge suppression effect and efficiency.

Embodiments 8 and 9 where the average magnetic circuit length Lc is longer relative to the winding length Lw of the coil, compared with Embodiment 6, show a little bit lower noise suppression effect and efficiency. Considering characteristics and handling properties, the average magnetic circuit length may be short. That is, Lc/Lw ratio. is preferable to be 6 or less.

The inductance elements of Embodiments 5 to 9, compared with the inductance element shown in for instance Comparative Example 7, need not dispose the toroidal winding. As a result, the winding step can be automated, placement of the core being easy. Accordingly, due to mass-production process, less expensive inductance elements can be provided. Further, owing to the lead terminal, due to taping packaging the mounting on the substrate can be automated with ease.

Further, weights of the inductance elements of Embodiment 6 and Comparative Example 6 both having the identical characteristics (efficiencies) are measured. The element of Embodiment 6 is 0.404 g, that of Comparative Example 6 being 572 g, that is approximately 29% light-weighting. Thus, the present inductance element shows approximately identical characteristics with those of the existing one, and being sufficiently lightweight.

EMBODIMENT 10

To the bobbin 10 identical with that of Embodiment 5, urethane sheathed wire of a diameter of 0.1 mm is wound by 150 turns to form a winding. The winding length Lw of the coil 4 is set at 12 mm. The both ends of the winding are stripped of the sheath to be solder-bonded to two pieces of lead terminals respectively. Next, as magnetic ribbon, a Co based amorphous alloy ribbon of a thickness 18 $\mu$m, a width 4.5 mm and a length 26 mm is prepared, this being used in a single layer. The Co based amorphous alloy ribbon is inserted penetrating through the hollow portion, forming in loop followed by stacking both ends of the alloy ribbon, the stacked portion being fixed with an adhesive tape. Thereafter, the connected portion is moved in the hollow portion of the bobbin.

Sample 1 is formed with a length of the connected portion (length of overlapped portion) Lg of 4 mm and an average magnetic circuit length Lc of 27 mm. The length Lg of the connected portion corresponds to 15% of the average magnetic circuit length Lc. As sample 2, one with a ratio of connected portion of 50%, as sample 3 one with a ratio of connected portion of 80% are prepared, respectively. Each of the connected portions is disposed in the hollow portion of the bobbin. In sample 4, two layers of magnetic ribbon are stacked to use. Further, the ratio of the connected portion is set identical with that of the sample 1, the connected portion being located outside the bobbin to manufacture an element (sample 5).

Inductance value of each inductance element at 50 kHz and 0.01 v is measured. The results are shown in Table 3.

TABLE 3

| | Sample No. | Number of Layers of Magnetic Ribbon | Position of Connecting Portion | Lg/Lc (%) | Inductance L ($\mu$H) | Easiness to assemble |
|---|---|---|---|---|---|---|
| Embodiment 10 | 1 | one | Inside the Coil | 13 | 278 | ○ |
| | 2 | one | Inside the Coil | 50 | 287 | ○ |
| | 3 | one | Inside the Coil | 80 | 291 | Δ |
| | 4 | two | Inside the Coil | 15 | 440 | ○ |
| | 5 | one | Outside the Coil | 13 | 249 | ◎ |

As obvious from Table 3, by disposing the connecting portion of the magnetic ribbon inside the hollow portion of the bobbin, the inductance can be improved. As obvious from comparison between samples 2 and 5, sample 2 shows a 15% improvement of inductance. This means that with the number of turns of approximately 7% less, identical inductance can be obtained. Accordingly, downsizing and lower cost of the inductance element can be realized. However, since sample 4 where the ratio of the connecting portion is 80% i s poor in assembling properties, the ratio of the connecting portion to the average magnetic circuit length is preferable to be 60% or less.

EMBODIMENTS 11 AND 12

Next, with the open magnetic circuit type inductance element of Embodiment 1 and the closed magnetic circuit type inductance element of Embodiment 6, ones consisting of two layers of amorphous alloy ribbon are manufactured as Embodiment 11 (open magnetic circuit type) and Embodiment 12 (closed magnetic circuit type).

With the inductance elements involving Embodiments 11 and 12, measurements and evaluations are implemented similarly with Embodiment 1. The results are shown in Table 4.

TABLE 4

| | Number of Turns per Length 10 mm | Magnetic Circuit | N/n Ratio | N/t Ratio | L/Lw Ratio | Element Volume ($mm^3$) | Surge Current Ipp (A) | Efficiency (%) |
|---|---|---|---|---|---|---|---|---|
| Embodiment 11 | 42 | Open | 21 | 2.3 | 1.0 | 162 | 0.26 | 87.6 |
| Embodiment 12 | 83 | Closed | 41.5 | 2.3 | 2.25 | 150 | 0.28 | 89.8 |

As obvious from Table 4, compared with Embodiments 1 or 6 that is a single layer, owing to an increase of cross section of the magnetic ribbon, surge current and efficiency are improved. However, due to two layers of the magnetic ribbon, when inserting the magnetic ribbon in the bobbin, the magnetic ribbon tends to be damaged, resulting in a little bit lower assembling properties.

As explained in the above, the inductance element of the present invention is excellent in winding efficiency, the step of winding being easily automated, the core also being easily located. In addition to these, the inductance element of the present invention has sufficient inductance characteristics. Accordingly, according to the present invention, the inductance element that is excellent in characteristics and less expensive can be provided.

While the invention has been described in terms of specific embodiments thereof, it is not intended to be limited thereto but rather only to the extent set forth in the claims.

What is claimed is:

1. An inductance element, comprising:

a coil comprising a winding formed by winding a coated wire, the winding having a number of turns (N) per 10 mm length of the winding, N being in the range of 20 to 500, the coil having a hollow portion whose both ends are opened; and a core comprising a single layer or a plurality of layers of a magnetic ribbon, the magnetic ribbon having a thickness in the range of 8 $\mu$m to 50 $\mu$m and a width in the range of 2 mm to 40 mm, and at least part of the single layer or the plurality of layers of the magnetic ribbon being disposed inside the hollow portion;

wherein a ratio N/n is in the range of 20 to 500, where n is a number of layers of the magnetic ribbon.

2. The inductance element as set forth in claim 1, wherein a ratio N/t is in the range of 1 per $\mu$m to 100 per $\mu$m, where t is a thickness in $\mu$m of the single layer or the plurality of layers of the magnetic ribbon.

3. The inductance element as set forth in claim 1, wherein the coil further comprises a cylindrical bobbin having a cylindrical hollow portion, the winding being formed around an external periphery of the cylindrical bobbin, at least part of the single layer or the plurality of layers of the magnetic ribbon being inserted in the cylindrical hollow portion of the cylindrical bobbin.

4. The inductance element as set forth in claim 3, wherein the cylindrical bobbin has a lead terminal, the winding being electrically connected to the lead terminal.

5. The inductance element as set forth in claim 3, wherein the cylindrical hollow portion of the cylindrical bobbin has both ends of which one is opened and the other is closed, at least part of the single layer or the plurality of layers of the magnetic ribbon being inserted into the cylindrical hollow portion of the cylindrical bobbin from the open end to form an open magnetic circuit.

6. The inductance element as set forth in claim 5, wherein at least part of the single layer or the plurality of layers of the magnetic ribbon is sealed in the cylindrical hollow portion of the cylindrical bobbin.

7. The inductance element as set forth in claim 5, wherein a ratio L/Lw is in the range of 0.7 to 1.6, where L is a length of the magnetic ribbon having the open magnetic circuit and Lw is a length of the winding.

8. A snubber, comprising an inductance element set forth in claim 1 connected to a driver of a switching element.

9. The inductance element as set forth in claim 1, wherein the magnetic ribbon is formed of one of a crystalline soft magnetic alloy, an amorphous soft magnetic alloy, and a soft magnetic alloy having a micro-crystallite structure.

10. An inductance element, comprising:

a coil provided with a winding having a hollow portion whose both ends are opened; and a core comprising a single layer or a plurality of layers of a magnetic ribbon, the magnetic ribbon having a thickness in the range of 4 $\mu$m to 50 $\mu$m and a width in the range of 2 mm to 40 mm, the single layer or the plurality of layers of the magnetic ribbon being disposed through the hollow portion, and both ends of the single layer or the plurality of layers of the magnetic ribbon being magnetically connected to form a closed magnetic circuit.

11. The inductance element as set forth in claim 14, wherein a ratio Lc/Lw is 6 or less, where Lc is an average magnetic circuit length which is an average length of the magnetic ribbon forming the closed magnetic circuit and Lw is a length of the winding.

12. The inductance element as set forth in claim 10, wherein the coil further comprises a cylindrical bobbin having a cylindrical hollow portion whose both ends are opened, the winding being formed around an external periphery of the cylindrical bobbin, the magnetic ribbon being disposed through the cylindrical hollow portion of the cylindrical bobbin.

13. The inductance element as set forth in claim 12, wherein the single layer or the plurality of layers of the magnetic ribbon forming the closed magnetic circuit has a connecting portion where a front surface of one end of the magnetic ribbon and a rear surface of another end of the magnetic ribbon are stacked, the connecting portion being disposed in the cylindrical hollow portion of the cylindrical bobbin.

14. The inductance element as set forth in claim 13, wherein a length of the connecting portion is 0.6 times or less of the average magnetic circuit length Lc of the magnetic ribbon forming the closed magnetic circuit.

15. The inductance element as set forth in claim 12, wherein the cylindrical bobbin has a lead terminal, the winding being electrically connected to the lead terminal.

16. An inductance element, comprising:

a coil provided with a winding having a hollow portion whose both ends are opened; and a core comprising a single layer or a plurality of layers of a magnetic ribbon, the magnetic ribbon having a thickness in the range of 4 $\mu$m to 50 $\mu$m and a width in the range of 2 mm to 40 mm, the single layer or the plurality of layers of the magnetic ribbon being disposed through the hollow portion, and both ends of the single layer or the plurality of layers of the magnetic ribbon being magnetically connected to form a closed magnetic circuit;

wherein the coil further comprises a cylindrical bobbin having a cylindrical hollow portion whose both ends are opened, the winding being formed around an external periphery of the cylindrical bobbin, the magnetic ribbon being disposed through the cylindrical hollow portion of the cylindrical bobbin;

wherein the magnetic ribbon forming the closed magnetic circuit has a connecting portion where a front surface of one end of the magnetic ribbon and a rear surface of another end are stacked, the connecting portion being disposed in the cylindrical hollow portion of the cylindrical bobbin.

17. The inductance element as set forth in claim 10, wherein the magnetic ribbon comprises one of a crystalline soft magnetic alloy, an amorphous soft magnetic alloy, and a soft magnetic alloy having micro-crystallite structure.

18. The inductance element as set forth in claim 1, wherein a number of layers of the magnetic ribbon is not more than 3.

19. The inductance element as set forth in claim 1, wherein a thickness of the magnetic ribbon is in the range of 10 $\mu$m to 30 $\mu$m.

20. The inductance element as set forth in claim 9, wherein the magnetic ribbon is formed of a permalloy comprising 55% to 85% by weight of Ni, 7% or less by weight of Mo, 2% to 27% by weight of Cu, and the remainder essentially consisting of Fe.

21. The inductance element as set forth in claim 9, wherein the magnetic ribbon is formed of an amorphous soft magnetic alloy expressible by a general formula, $(M_{1-y}M'_y)_{100-z}X_z$, where M is one of Fe and Co, M' is one of Ti, V, Cr, Mn, Ni, Cu, Zr, Nb, Mo, Ta, and W, X is one of B, Si, C, and P, and y and z are numbers satisfying $0 \leqq y \leqq 0.5$ and (10 atomic %)$\leqq z \leqq$(35 atomic %).

22. The inductance element as set forth in claim 9, wherein the magnetic ribbon is formed of an amorphous soft magnetic alloy expressible by a general formula, $(Ni_{1-b}Fe_b)_{100-y-z-w}M''_ySi_zB_w$, where M" is one of V, Cr, Mn, Co, Nb, Mo, Ta, W, and Zr, and b, y, z, and w are numbers satisfying $0.2 \leqq b \leqq 0.5$, (0.05 atomic %)$\leqq y \leqq$(10 atomic %), (4 atomic %)$\leqq z \leqq$(12 atomic %), (5 atomic %)$\leqq w \leqq$(20 atomic %), and (15 atomic %)$\leqq (z+w) \leqq$(30 atomic %).

23. The inductance element as set forth in claim 9, wherein the magnetic ribbon is formed of a soft magnetic alloy having a micro-crystallite structure, expressible by a general formula, $Fe_{100-c-d-e-f}Cu_cM'''_dSi_eB_f$, where M''' is one of Ti, Zr, Hf. V, Nb, Ta, Cr, Mo, W, Mn, Ni, Co, and Al, and c, d, e, and f are numbers satisfying (0.01 atomic %)$\leqq c \leqq$(4 atomic %), (0.01 atomic %)$\leqq d \leqq$(10 atomic %), (10 atomic %)$\leqq e \leqq$(25 atomic %), (3 atomic %)$\leqq f \leqq$(12 atomic %), and (17 atomic %)$\leqq (e+f) \leqq$(30 atomic %).

* * * * *